US009551272B2

(12) United States Patent
Sheidler et al.

(10) Patent No.: US 9,551,272 B2
(45) Date of Patent: Jan. 24, 2017

(54) POWER SYSTEM WITH HEAT TRANSFER CIRCUITS

(71) Applicant: DEERE & COMPANY, Moline, IL (US)

(72) Inventors: Alan D. Sheidler, Moline, IL (US); Matthew R. Evers, Cedar Falls, IA (US); Craig W. Lohmann, Denver, IA (US)

(73) Assignee: DEERE & COMPANY, Moline, IL (US)

( * ) Notice: Subject to any disclaimer, the term of this patent is extended or adjusted under 35 U.S.C. 154(b) by 132 days.

(21) Appl. No.: 14/533,643

(22) Filed: Nov. 5, 2014

(65) Prior Publication Data

US 2016/0123219 A1 May 5, 2016

(51) Int. Cl.

| | |
|---|---|
| ***F01P 11/08*** | (2006.01) |
| ***F01P 3/02*** | (2006.01) |
| ***F01N 3/02*** | (2006.01) |
| *F01M 5/00* | (2006.01) |
| *F01P 7/16* | (2006.01) |
| *F01P 3/20* | (2006.01) |

(52) U.S. Cl.

CPC ..... *F01P 11/08* (2013.01); *F01N 3/0205* (2013.01); *F01P 3/02* (2013.01); *F01M 5/002* (2013.01); *F01P 3/20* (2013.01); *F01P 7/165* (2013.01); *F01P 2060/04* (2013.01)

(58) Field of Classification Search

CPC ..... F01P 11/08; F01P 2060/04; F01P 3/20; F01P 7/165; F01M 5/002

USPC ..... 123/41.33

See application file for complete search history.

(56) References Cited

U.S. PATENT DOCUMENTS

| | | | | |
|---|---|---|---|---|
| 3,752,132 | A | 8/1973 | Bentz et al. | |
| 5,180,003 | A | 1/1993 | Kouzel et al. | |
| 6,149,290 | A * | 11/2000 | Quigley | B60P 3/16 296/64 |
| 6,282,899 | B1 * | 9/2001 | Gladden | F02B 33/44 60/612 |
| 7,610,954 | B2 | 11/2009 | Ando et al. | |
| 7,717,069 | B2 | 5/2010 | Mokire et al. | |
| 8,375,926 | B2 | 2/2013 | Sheidler et al. | |
| 2008/0035080 | A1 * | 2/2008 | Haase | F01P 7/16 123/41.1 |
| 2008/0168770 | A1 * | 7/2008 | Mokire | F01P 3/18 60/599 |
| 2009/0107424 | A1 * | 4/2009 | Blassnitz | F01P 7/048 123/41.12 |
| 2010/0037608 | A1 | 2/2010 | Dierbeck | |
| 2011/0308778 | A1 * | 12/2011 | Tsuda | 165/157 |
| 2012/0275773 | A1 * | 11/2012 | Floyd | F01N 3/2066 392/441 |
| 2013/0139491 | A1 | 6/2013 | Garnepudi | |

FOREIGN PATENT DOCUMENTS

CN 201747445 U 2/2011

* cited by examiner

*Primary Examiner* — Lindsay Low
*Assistant Examiner* — Charles Brauch

(57) ABSTRACT

A power system including an engine, a first heat transfer circuit, and a second heat transfer circuit. The first heat transfer circuit includes a first heat exchanger that cools a first circuit fluid. The first circuit fluid cools a block and a head of the engine. The second heat transfer circuit includes a second heat exchanger that cools a second circuit fluid. The second circuit fluid cools a lube oil cooler.

19 Claims, 1 Drawing Sheet

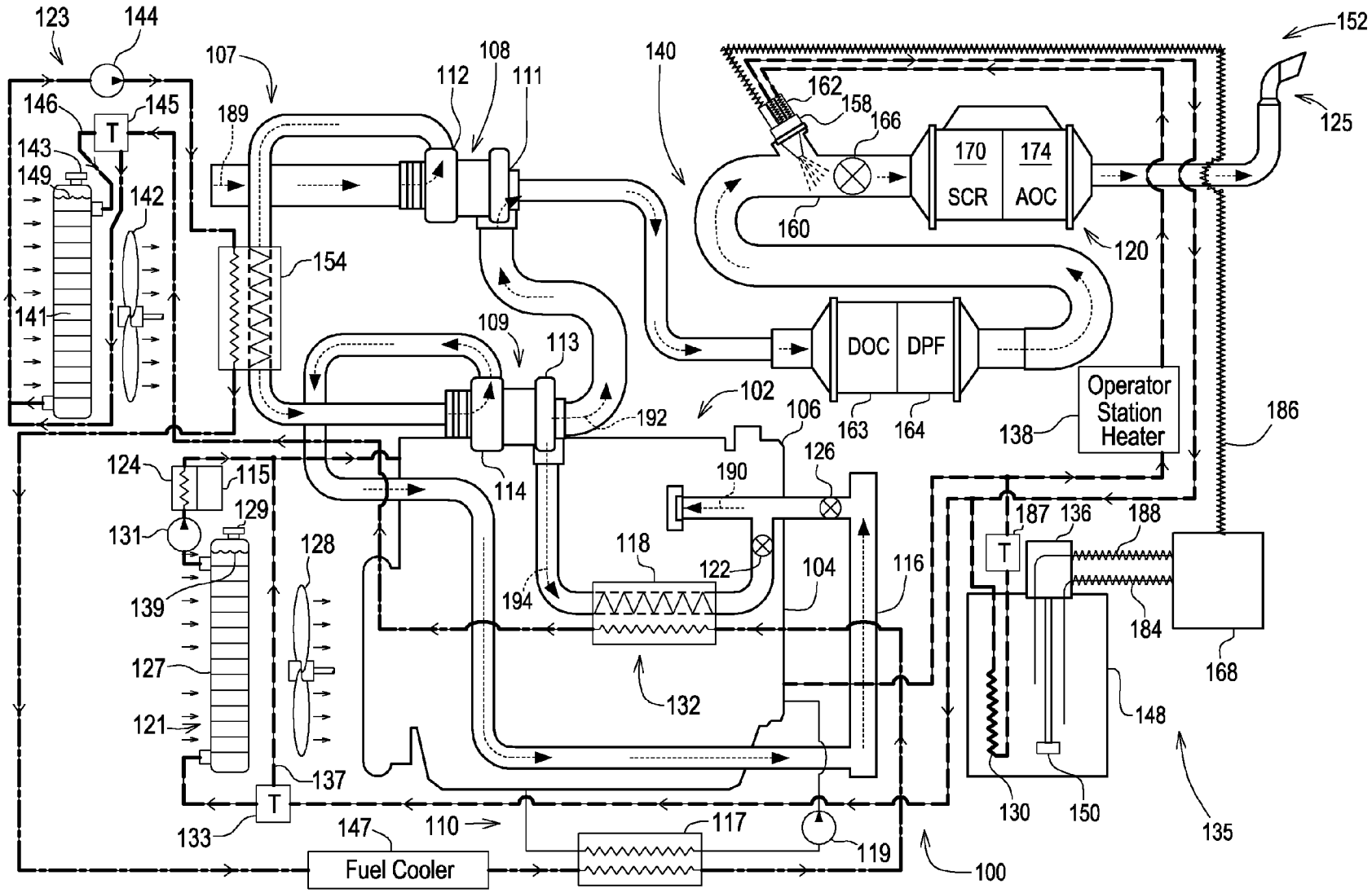
Operator Station Heater
SCR
AOC
DPF
DOC
Fuel Cooler
T
100
102
104
106
107
108
109
110
111
112
113
114
115
116
117
118
119
120
121
122
123
124
125
126
127
128
129
130
131
132
133
135
136
137
138
139
140
141
142
143
144
145
146
147
148
149
150
152
154
158
160
162
163
164
166
168
170
174
184
186
187
188
189
190
192
194

POWER SYSTEM WITH HEAT TRANSFER CIRCUITS

FIELD OF THE DISCLOSURE

The present disclosure relates to a power system having heat transfer circuits.

BACKGROUND OF THE DISCLOSURE

A power system may include an engine and a heat transfer system for heating some components and cooling other components. Running the engine at too high of a temperature may cause preignition, knock, burned pistons and valves, and lubrication failure. Conversely, running the engine at too low of a temperature may cause unnecessary wear, poor fuel economy, and the accumulation of water and sludge in the crankcase. Regulating temperatures with the heat transfer system keeps the engine at its best temperature levels for operation.

Engines and heat transfer systems currently in development for emissions regulated markets are being designed to provide cooling and heating for many different engine subsystems. Engine power levels are increasing and emissions regulations are tightening, and as a result, cooling and heating needs to support such engines are resulting in larger and larger pumps, heat exchangers, and fans. Despite such increases in size, certain components in the engine may be operating at temperatures that are too high and others, too low. In some cases, these increases in size result in a lot of the engine's power being used for cooling and heating purposes, rather than for propelling a vehicle, for example.

SUMMARY OF THE DISCLOSURE

Disclosed is a power system having an engine, a first heat transfer circuit, and a second heat transfer circuit. The first heat transfer circuit includes a first heat exchanger that cools a first circuit fluid. The first circuit fluid cools a block and a head of the engine. The second heat transfer circuit includes a second heat exchanger that cools a second circuit fluid. The second circuit fluid cools a lube oil cooler.

BRIEF DESCRIPTION OF THE DRAWING

The detailed description refers to the accompanying FIG. 1, which is a schematic illustration of an example of a power system having first and second heat transfer circuits.

DETAILED DESCRIPTION OF THE DRAWINGS

In FIG. 1, there is shown a schematic illustration of a power system 100 for providing power to a variety of machines. For example, the machine may be an on-highway truck, a construction vehicle, a marine vessel, a stationary generator, an automobile, an agricultural vehicle, or a recreational vehicle. The power system 100 includes an engine 102 that may be any kind that produces an exhaust gas, the exhaust gas being represented by directional arrow 192. The engine 102 may be a gasoline engine, a diesel engine, or any other gaseous fuel burning engine. The engine 102 may be of any size, with any number cylinders, and in any configuration (e.g., "V," inline, and radial).

The engine 102 is lubricated with a lube oil, and includes a block 104 and a head 106 mounted thereto. A first heat transfer circuit 121 includes a first heat exchanger 127 for cooling a first circuit fluid 139 that circulates through the block 104 and the head 106. The block 104 and the head 106 may include passages for first circuit fluid 139 to circulate around the cylinders and valves of the engine 102.

Further, a second heat transfer circuit 123 includes a second heat exchanger 141 and a lube oil cooler 117, wherein the second heat exchanger 141 cools a second circuit fluid 149 that circulates through the lube oil cooler 117. The lube oil cooler 117 is part of a lube oil system 110. The lube oil in the lube oil system 110 may be circulated by a lube oil pump 119 and is separate, and distinct, from the first and second circuit fluids 139, 149. The first circuit 121 is separate from the second heat transfer circuit 123, such that the first circuit fluid 139 does not mix with the second circuit fluid 149. This allows the first circuit fluid 139 and the second circuit fluid 149 to be at their own temperatures, and to build their own vapor pressures within their respective circuits. The first and second circuit fluids 139, 149 may enter one end of their respective first and second heat exchangers 127, 141 and circulate through a series of small tubes surrounded by fins and air passages. The first and second circuit fluids 139, 149 then reach the opposite ends and are recirculated. Each of the first and second heat exchangers 127, 141 may be tubular or tube-and-fin type core radiators, to name just a couple of examples.

The first heat exchanger 127 may be cooled with a first fan 128, and the second heat exchanger 141, with a second fan 142. In other embodiments, the first and second heat exchangers 127, 141 may be cooled with a single fan. Each of the first and second fans 128, 142 may be driven by the crankshaft of the engine 102 or an electric motor, for example. The first and second fans 128, 142 may be, for example, suction-type or blower-type fans. The different components of the first and second circuits 121, 123 may be coupled to one another by connecting hoses that provide flexible connections therebetween.

This combination of the first and second heat exchangers 127, 141 and the first and second fans 128, 142 results in smaller, more affordable components. Further, the combination results in the ability to control the first and second circuits 121, 123, so as to conserve power and fuel usage related thereto. Additionally, the combination of the first and second heat exchangers 127, 141 may result in more favorable temperature distributions therein. During low loads on the power system 100 or at low ambient temperatures, one of the first and second fans 128, 142 may be off or at a reduced speed. As just one specific example, when there is a high operating load on the engine 102 and when there is a low ambient temperature, the first fan 128 used for cooling the first heat exchanger 127 may be in operation. But in contrast, the second fan 142 used for cooling the second heat exchanger 141 may be off or reduced in speed, as a result of the lube oil and the intake gas flow already being relatively cold. By turning off or reducing the speed of the second fan 142, the overall power use by the first and second circuits 121, 123 is lower. This results in improved power and fuel efficiency characteristics of the power system 100.

An engine control unit 115 may be used for controlling the first and second fans 128, 142. Moreover, the ECU 115 may have the following additional functions: converting analog sensor inputs to digital outputs, performing mathematical computations, performing diagnostics, and storing information. As shown, the first circuit 121 may include an engine control unit (ECU) cooler 124 for cooling the ECU 115.

A first pump 131 may be used for circulating and pumping the first circuit fluid 139, and similarly, a second pump 144 may be used for circulating the second circuit fluid 149. The first and second pumps 131, 144 may be fixed or variable speed pumps and they may be electrically or mechanically driven, depending on the application. By having the first and second pumps 131, 144, one may be on and one may be off, so as to preserve the power and fuel of the engine 102. In some embodiments of the power system 100, the first and second circuits 121, 123 may share a single pump, having a pair of pumping vanes, for example.

The power system 100 may comprise an intake system 107 for introducing a fresh intake gas into the engine 102, as indicated by directional arrow 189. Among other things, the intake system 107 may include an intake manifold in communication with the cylinders, a compressor 112, and an air throttle actuator 126.

In the illustrated embodiment, the second circuit 123 may include an interstage cooler 154 that is fluidly coupled to the second heat exchanger 141, but in other embodiments, the first circuit 121 may include the interstage cooler 154. During operation, the interstage cooler 154 cools the fresh intake gas exiting the first turbocharger 108 and entering a second turbocharger 109. And as illustrated, an air-to-air aftercooler 116 may be used for cooling the fresh intake gas exiting the second turbocharger 109. The air throttle actuator 126 may be positioned downstream of the air-to-air aftercooler 116, and it may be a flap type valve controlled by the ECU 115 for regulating the air-fuel ratio. The second circuit 123, as shown, may include a fuel cooler 147 positioned downstream of the interstage cooler 154 and upstream of the lube oil cooler 117. In contrast, in other embodiments, the first circuit 121 may include the fuel cooler 147.

Further, the power system 100 includes an exhaust system 140 for directing exhaust gas from the engine 102 to the atmosphere. The exhaust system 140 may include an exhaust manifold in fluid communication with the cylinders. The pressure and volume of the exhaust gas drives a turbine 111, allowing it to drive the compressor 112 via a shaft. The first turbocharger 108 is the combination of the compressor 112, the shaft, and the turbine 111. The second turbocharger 109 is the combination of a second compressor 114, a second shaft, and a second turbine 113.

The power system 100 may also have an EGR system 132 for receiving a recirculated portion of the exhaust gas, as indicated by directional arrow 194. The intake gas is indicated by directional arrow 190, and it is a combination of the fresh intake gas and the recirculated portion of the exhaust gas. The EGR system 132 has an EGR valve 122 and an EGR mixer. The second circuit 123 may include an exhaust gas recirculation (EGR) cooler 118 fluidly coupled to the second heat exchanger 141, though in other embodiments, the EGR cooler 118 may be included as part of the first circuit 121. The EGR cooler 118 cools the recirculated exhaust gas. Although the EGR valve 122 is illustrated as being downstream of EGR cooler 118, it could also be positioned upstream thereof, for example.

As further shown, the exhaust system 140 includes an aftertreatment system 120, and at least some of the exhaust gas passes therethrough. The aftertreatment system 120 removes various chemical compounds and particulate emissions present in the exhaust gas received from the engine 102. After being treated by the aftertreatment system 120, the exhaust gas is expelled into the atmosphere via a tailpipe 125.

The aftertreatment system 120 is shown having a diesel oxidation catalyst (DOC) 163, a diesel particulate filter (DPF) 164, and a selective catalytic reduction (SCR) system 152, though the need for such components depends on the particular size and application of the power system 100. The SCR system 152 has a reductant delivery system 135, an SCR catalyst 170, and an ammonia oxidation catalyst AOC 174. The exhaust gas may flow through the DOC 163, the DPF 164, the SCR catalyst 170, and the AOC 174, and is then, as just mentioned, expel into the atmosphere via the tailpipe 125. Exhaust gas that is treated in the aftertreatment system 120 and released into the atmosphere contains significantly fewer pollutants (e.g., particulate matter, $NO_x$, and hydrocarbons) than an untreated exhaust gas.

Moreover, the reductant delivery system 135 may include a reductant tank 148 for storing the reductant. One example of a reductant is a solution having 32.5% high purity urea and 67.5% deionized water (e.g., DEF), a solution that decomposes as it travels through a decomposition tube 160 to produce ammonia. Such a reductant may begin to freeze at approximately 12 deg F (−11 deg C). If the reductant freezes when the power system 100 is shut down, then the reductant may need to be thawed before the SCR system 152 can function.

The reductant delivery system 135 may include a reductant header 136 mounted to the reductant tank 148, the reductant header 136 further including, in some embodiments, a level sensor 150 for measuring a quantity of the reductant in the reductant tank 148. The level sensor 150 may include a float for floating at a liquid/air surface interface of reductant included within the reductant tank 148.

The first circuit fluid 139 circulates through the reductant heater 130, so as to warm the reductant in the reductant tank 148, thereby reducing the risk that the reductant freezes therein and/or thawing the reductant upon startup. In an alternative embodiment of the power system 100, the reductant heater 130 may, instead, be included as part of the second circuit 123 or it may be an electrically resistive heating element. When the first circuit fluid 139 exits the first heat exchanger 127, the first circuit fluid 139 circulates through the block 104 and the head 106 and then periodically circulates through reductant heater 130. The reductant heater 130 periodically warms a reductant, for example when the power system 100 is turned on and the ambient temperature is below the freezing point of the reductant.

The reductant heater 130 receives a steady flow of the first circuit fluid 139 when, for example, the reductant tank thermostat 187 is in an open position. Alternatively, the reductant heater 130 does not receive a steady flow of the first circuit fluid 139 when, for example, the reductant tank thermostat 187 is in a closed position. The reductant tank thermostat 187 may be in the closed position, so as to protect the reductant from chemically breaking down as a result of too high of temperatures. In the illustrated power system 100, the first circuit 121 includes an operator station heater 138, fluidly coupled to the first heat exchanger 127, for warming the inside of an operator station.

At least one of the first and second heat transfer circuits 121, 123 may be an opened system or a closed system, depending on the specific application. Further, the first and second circuit fluids 139, 149 may be, for example, water, fresh water, sea water, an antifreeze mixture, a glycol mixture and the like. In some embodiments of the power system 100, the first and second circuit fluids 139, 149 may be the same kind of fluid, while in other embodiments, they may be unique relative to one another. The first and second circuits 121, 123 may share a single surge tank or have separate surge tanks. The single surge tank embodiment may have a relatively large tank with independent chambers, each of which could draw from an overflow bottle. The overflow bottles would serve as small reservoirs for supplying the respective first and second circuit fluids 139, 149, and they would provide a common fill point for service needs.

The decomposition tube 160 may be positioned downstream of the reductant injector 158 but upstream of the SCR catalyst 170. The reductant injector 158 may be, for example, an injector that is selectively controllable to inject reductant directly into the exhaust gas. As shown, the SCR system 152 may include a reductant mixer 166 that is positioned upstream of the SCR catalyst 170 and downstream of the reductant injector 158. The first circuit 121 may include a reductant injector heater 162, fluidly coupled to the first heat exchanger 127, for warming the reductant injector 158.

The reductant delivery system 135 may also include a reductant pressure source and a reductant extraction passage 184. The extraction passage 184 may be coupled fluidly to the reductant tank 148 and the reductant pressure source therebetween. Although the extraction passage 184 is shown extending into the reductant tank 148, in other embodiments, the extraction passage 184 may be coupled to an extraction tube via the reductant header 136. The reductant delivery system 135 may further include a reductant supply module 168.

The reductant delivery system 135 may also include a reductant dosing passage 186 and a reductant return passage 188. The return passage 188 is shown extending into the reductant tank 148, though in other embodiments, the return passage 188 may be coupled to a return tube via the reductant header 136.

As mentioned above, one example of a reductant is a solution having 32.5% high purity urea and 67.5% deionized water (e.g., DEF), which decomposes as it travels through the decomposition tube 160 to produce ammonia. The ammonia reacts with NO in the presence of the SCR catalyst 170, and it reduces the NO to less harmful emissions, such as $N_2$ and $H_2O$.

When the engine 102 is operating, vapor pressures build up in the first and second circuits 121, 123. As a result, the first circuit 121 may include a first pressure relief valve 129 for opening at a first pressure, while the second circuit 123 may include a second pressure relief valve 143 for opening at a second pressure. The first and second pressure relief valves 129, 143 are shown as being part of their respective first and second heat exchangers 127, 141, but could be placed anywhere in their respective systems. Ultimately, the purpose of each is to provide relief if the pressure in either the first or second circuit 121, 123 becomes too high. The first and second pressure relief valves 129,143 may be mechanically controlled (e.g., heat activated) or could be electronically controlled (e.g., ECU 115 activated).

The second pressure that opens the second pressure relief valve 143 may be higher than the first pressure that opens the first pressure relief valve 129, as a result of the second circuit 123 and its components being able to withstand higher pressures and temperatures. Raising the pressure in the second circuit 123 prevents cavitation and boiling therein, which might otherwise damage its components. The second heat exchanger 141 may be designed for withstanding higher operating pressures (e.g., 18-21 psi or higher), while in contrast, the first heat exchanger 127 may be designed for lower pressures (e.g., 10-15 psi).

The first circuit 121 may include a first thermostat 133 and first bypass passage 137. The first thermostat 133 provides control of the first circuit 121. To illustrate, when the first thermostat 133 is in a standard position, the first circuit fluid 139 circulates through the first heat exchanger 127 for cooling the first circuit fluid 139 and, thus, the other components of the first circuit 121. Alternatively, when the first thermostat 133 is in a bypass position, the first circuit fluid 139 bypasses the first heat exchanger 127. This allows the first circuit fluid 139 and the components in the first circuit 121 to warm up.

The second circuit 123 may include a second thermostat 145 and a second bypass passage 146. The second thermostat 145 provides control of the second circuit 123. For example, when the second thermostat 145 is in a standard position, the second circuit fluid 149 circulates through the second heat exchanger 141. This cools the second circuit fluid 149, and the second circuit fluid 149 cools the other components in the second circuit 123. Alternatively, when the second thermostat 145 is in a bypass position, the second circuit fluid 149 bypasses the second heat exchanger 141, letting the second circuit fluid 149 and the other components in the second circuit 123 to warm up quickly.

Adjustments in the first and second thermostats 133, 145 may be controlled mechanically or by the ECU 115. In some embodiments, the first thermostat 133 may adjust to the standard position thereof at a lower temperature than the second thermostat 145 adjusts to the standard position thereof, meaning that the second circuit 123 operates at a higher temperature than the first circuit 121. For example, the first circuit 121 may operate at a lower temperature for adequately cooling the cylinders of the engine 102, which in many operating modes, requires a steady flow of the first circuit fluid 139 through the first heat exchanger 127. In contrast, the second circuit 123 may operate at a higher temperature for adequately warming the reductant heater 130 and the operation station heater 138, both of which require significant amounts of heat during certain operating conditions (e.g., upon startup of the power system 100 in a cold environment).

In the illustrated power system 100, the first pump 131 circulates the first circuit fluid 139 through the ECU cooler 124, and the block 104, and the head 106. The first circuit fluid 139 may enter the block 104 first or enter the head 106 first. Placing the ECU cooler 124, block 104, and head 106 in these positions may ensure that the first circuit fluid 139 is cool when it circulates therethrough, as a result of being cooled by the first heat exchanger 127. Next, the first circuit fluid 139 circulates out of the block 104 and the head 106 and into the reductant heater 130, assuming that the reductant tank thermostat 187 allows the first circuit fluid 139 to circulate thereto. Placing the reductant heater 130 in this position ensures that the first circuit fluid 139 is quickly warmed for heating the reductant, as a result of being quickly heated by the block 104 and the head 106.

In the illustrated embodiment of the power system 100, the first circuit fluid 139 circulates through the operation station heater 138 and then through the reductant injector heater 162. Placing the operation station heater 138 in this position, in the first circuit 121, ensures that the operation station heater 138 is able to provide quick and adequate heat to the operator of the power system 100, as a result of the first circuit fluid 139 being quickly warmed by the block 104 and the head 106 (but not being cooled by other components). Finally, depending on the needs of the power system 100 and the position of the first thermostat 133, the first circuit fluid 139 circulates through either the first bypass passage 137 or through the first heat exchanger 127. The circulation of the first circuit fluid 139, through one revolution through the first circuit 121, may be referred to a first heat transfer cycle.

Further in the illustrated power system 100, the second pump 144 circulates the second circuit fluid 149 through the interstage cooler 154 and then through the fuel cooler 147. Next, the second circuit fluid 149 may circulate into the lube oil cooler 117 and then circulates into the EGR cooler 118. Finally, depending on the position of the second thermostat 145, the second circuit fluid 149 may circulate through either the second bypass passage 146 or through the second heat exchanger 141.

In the second circuit 123, the second circuit fluid 149 may gradually rise as it circulates through the interstage cooler 154, then through the fuel cooler 147, then through the lube oil cooler 117, and finally through the EGR cooler 118. Placing the interstage cooler 154 before these other components in the second circuit 123 ensures that the second circuit fluid 149 is at a relatively low temperature when it circulates therethrough. This allows the interstage cooler 154 to lower the temperature of the fresh intake gas. Additionally, placing the lube oil cooler 117 before the EGR cooler 118 ensures that the lube oil cooler 177 is at a low enough temperature to cool the lube oil. During some operating modes, the EGR cooler 118 operates at a high temperature, so even though the second circuit fluid 149 has already been warmed (by the interstage cooler 154, the fuel cooler 147, and the lube oil cooler 117), the second circuit fluid 149 is still cool enough to lower the temperature of the EGR cooler 118 and the recirculated exhaust gas flowing therethrough. The circulation of the second circuit fluid 149, through one revolution through the second circuit 123, may be referred to a second heat transfer cycle.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A power system, comprising:

an engine comprising a block and a head mounted thereto, the engine being lubricated by a lube oil;

a first heat transfer circuit coupled to the engine and comprising a first heat exchanger, the first heat exchanger being configured to cool a first circuit fluid that cools the block and the head, the first heat transfer circuit further comprising a first thermostat and a first bypass passage, and when the first thermostat is in a standard position, the first circuit fluid circulates through the first heat exchanger, and when the first thermostat is in a bypass position, the first circuit fluid bypasses the first heat exchanger; and a second heat transfer circuit coupled to the engine and comprising a second heat exchanger and a lube oil cooler fluidly coupled thereto, the second heat exchanger being configured to cool a second circuit fluid that cools the lube oil cooler, and the lube oil cooler being configured to cool the lube oil, the second heat transfer circuit further comprising a second thermostat and a second bypass passage, and when the second thermostat is in a standard position, the second circuit fluid circulates through the second heat exchanger, and when the second thermostat is in a bypass position, the second circuit fluid bypasses the heat exchanger.

2. The power system of claim 1, wherein the first heat transfer circuit comprises a first pressure relief valve and is configured to open at a first pressure, and the second heat transfer circuit comprises a second pressure relief valve and is configured to open at a second pressure, and the second pressure is higher than the first pressure.

3. The power system of claim 1, wherein the first heat transfer circuit is separate from the second heat transfer circuit, such that the first circuit fluid does not mix with the second circuit fluid.

4. The power system of claim 1, wherein the first heat transfer circuit comprises a reductant heater fluidly coupled to the first heat exchanger, the reductant heater is configured to warm a reductant, and the block is positioned upstream of the reductant header with respect to a first heat transfer cycle that begins at an inlet of the first heat exchanger.

5. The power system of claim 1, wherein the first heat transfer circuit comprises a reductant injector heater fluidly coupled to the first heat exchanger, the reductant injector heater is configured to warm a reductant injector, and the block is positioned upstream of the reductant injector heater with respect to a first heat transfer cycle that begins at an inlet of the first heat exchanger.

6. The power system of claim 1, wherein the first heat transfer circuit comprises an operator station heater fluidly coupled to the first heat exchanger, the operator station heater is configured to warm ambient air for heating an operator station.

7. The power system of claim 6, wherein the block is positioned upstream of the operator station heater with respect to a first heat transfer cycle that begins at an inlet of the first heat exchanger.

8. The power system of claim 1, wherein the first heat transfer circuit comprises:

a reductant heater fluidly coupled to the first heat exchanger, the reductant heater is configured to warm a reductant;

an operator station heater fluidly coupled to the first heat exchanger, the operator station heater is configured to warm ambient air for heating an operator station; and a reductant injector heater fluidly coupled to the first heat exchanger, the reductant injector heater is configured to warm a reductant injector.

9. The power system of claim 8, the block is positioned upstream of the reductant injector heater, and the operator station heater is positioned upstream of the reductant injector heater with respect to a first heat transfer cycle that begins at an inlet of the first heat exchanger.

10. The power system of claim 1, wherein the second heat transfer circuit comprises an interstage cooler fluidly coupled to the second heat exchanger, and the interstage cooler is configured to cool a fresh intake gas that is exiting a first turbocharger and entering a second turbocharger.

11. The power system of claim 10, wherein the interstage cooler is positioned upstream of the lube oil cooler with respect to a first heat transfer cycle that begins at an inlet of the second heat exchanger.

12. The power system of claim 1, wherein the second heat transfer circuit comprises a fuel cooler fluidly coupled to the second heat exchanger.

13. The power system of claim 12, wherein the fuel cooler is positioned upstream of the lube oil cooler with respect to a first heat transfer cycle that begins at an inlet of the second heat exchanger.

14. The power system of claim 1, wherein the second heat transfer circuit comprises an exhaust gas recirculation (EGR) cooler fluidly coupled to the second heat exchanger, and the EGR cooler is configured to cool a recirculated exhaust gas.

15. The power system of claim 14, the lube oil cooler is positioned upstream of the EGR cooler with respect to a second heat transfer cycle that begins at an inlet of the second heat exchanger.

16. The power system of claim 1, wherein the second heat transfer circuit comprises:

an interstage cooler fluidly coupled to the second heat exchanger, the interstage cooler is configured to cool a fresh intake gas exiting a first turbocharger and entering a second turbocharger; and an exhaust gas recirculation (EGR) cooler fluidly coupled to the second heat exchanger, the EGR cooler is configured to cool a recirculated exhaust gas.

17. The power system of claim 16, wherein the interstage cooler is positioned upstream of the lube oil cooler, and the lube oil cooler is positioned upstream of the EGR cooler with respect to a second heat transfer cycle that begins at an inlet of the second heat exchanger.

18. The power system of claim 1, wherein:

the first heat transfer circuit comprises:

a reductant heater that is fluidly coupled to the first heat exchanger, the reductant heater is configured to warm a diesel exhaust fluid;

an operator station heater that is fluidly coupled to the first heat exchanger, the operator station heater is configured to warm ambient air for heating an operator station; and a reductant injector heater that is fluidly coupled to the first heat exchanger, the reductant injector heater is configured to warm a reductant injector; and the second heat transfer circuit comprises:

an interstage cooler that is fluidly coupled to the second heat exchanger, the interstage cooler is configured to cool a fresh intake gas exiting a first turbocharger and entering a second turbocharger; and an exhaust gas recirculation (EGR) cooler that is fluidly coupled to the second heat exchanger, the EGR cooler is configured to cool a recirculated exhaust gas.

19. The power system of claim 18, wherein:

the block is positioned upstream of the reductant injector heater, and the operator station heater is positioned upstream of the reductant injector heater with respect to a first heat transfer cycle that begins at an inlet of the first heat exchanger; and the interstage cooler is positioned upstream of the lube oil cooler, and the lube oil cooler is positioned upstream of the EGR cooler with respect to a second heat transfer cycle that begins at an inlet of the second heat exchanger.

* * * * *